US008449348B2

(12) United States Patent
Sondag

(10) Patent No.: US 8,449,348 B2
(45) Date of Patent: May 28, 2013

(54) TECHNIQUES FOR DEBRIS REDUCTION WHEN PERFORMING EDGE DELETION ON COATED ARTICLES HAVING TEMPORARY PROTECTIVE COATINGS APPLIED THERETO

(75) Inventor: Peter Sondag, Perl-Borg (DE)

(73) Assignee: Centre Luxembourg de Recherches pour le Verre et la Ceramique S.A. (C.R.V.C.), Grand Duche de Luxembourg (LU)

( * ) Notice: Subject to any disclaimer, the term of this patent is extended or adjusted under 35 U.S.C. 154(b) by 428 days.

(21) Appl. No.: 12/318,968

(22) Filed: Jan. 13, 2009

(65) Prior Publication Data

US 2010/0178850 A1 Jul. 15, 2010

(51) Int. Cl.
*B24B 49/00* (2012.01)
*B24B 1/00* (2006.01)

(52) U.S. Cl.
USPC ..... 451/11; 451/44

(58) Field of Classification Search
USPC ..... 451/44, 150, 160, 182, 188, 260, 451/412, 456
See application file for complete search history.

(56) References Cited

U.S. PATENT DOCUMENTS 4,716,686 A 1/1988 Lisec
5,265,382 A * 11/1993 Park ..... 451/44
5,713,986 A 2/1998 Franz et al.
5,934,892 A * 8/1999 Rabovitser et al. ..... 431/10
5,934,982 A 8/1999 Vianello et al.
6,971,948 B2 * 12/2005 Valek et al. ..... 451/190
6,988,938 B2 * 1/2006 Valek et al. ..... 451/57
7,125,462 B2 10/2006 Disteldorf
7,140,953 B1 * 11/2006 Raynauld ..... 451/57
2005/0210921 A1 9/2005 Richardson et al.
2008/0302462 A1 12/2008 Sol et al.

FOREIGN PATENT DOCUMENTS

DE 100 20 800 1/2001
EP 0 839 602 5/1998

OTHER PUBLICATIONS

U.S. Appl. No. 12/222,071, filed Jul. 31, 2008; Varaprasad.
U.S. Appl. No. 12/222,459, filed Aug. 8, 2008; Varaprasad et al.

* cited by examiner

*Primary Examiner* — Maurina Rachuba
(74) *Attorney, Agent, or Firm* — Nixon & Vanderhye P.C.

(57) ABSTRACT

Certain example embodiments of this invention relate to techniques for edge deleting coatings supported by coated articles while a temporary protective coating is applied thereto. More particularly, a stationary, enlarged, and higher powered aspirator is connected to flexible tubing, which itself has an enlarged diameter, that has a nozzle located proximate to a grinding wheel on an edge deletion unit is provided in connection with an edge deletion table. Advantageously, the edge deletion table and aspirator of certain example embodiments are capable of performing edge deletion and removal of a temporary protective coating substantially simultaneously (e.g., from a common area of interest), during which process the debris produced when edge deletion is performed is controlled and removed from the substrate of interest.

2 Claims, 4 Drawing Sheets

TECHNIQUES FOR DEBRIS REDUCTION WHEN PERFORMING EDGE DELETION ON COATED ARTICLES HAVING TEMPORARY PROTECTIVE COATINGS APPLIED THERETO

FIELD OF THE INVENTION

Certain example embodiments of this invention relate to edge deletion for coated articles. More particularly, certain example embodiments of this invention relate to techniques for edge deleting coatings provided to coated articles when temporary protective coatings are applied thereto, e.g., at common areas of interest. Additionally, certain example embodiments advantageously make it possible to control the debris produced when edge deletion is performed on a coated article having a temporary protective coatings applied thereto.

BACKGROUND AND SUMMARY OF EXAMPLE EMBODIMENTS OF THE INVENTION

Coated glass sheets often are easily damaged. For example, coated glass sheets sometimes are less durable while in the annealed state (e.g., prior to tempering). Indeed, glass sheets often are highly susceptible to damage during cutting, loading/unloading from glass racks or pallets, shipment, edge seaming, post-washing handling, etc. The coated side of the coated sheets are the most vulnerable to damage (e.g., scratching and the like) in this regard.

For example, coated sheets are often scratched due to one or more of rubbing up against other sheets or the like during shipment, pliers used by glass handlers, abrasion caused by gloves worn by glass handlers, brushes used during the washing, and other types of rubbing/abrasion. Additionally, corrosion is also a significant cause of damage and often is caused by high humidity conditions, acid rain, and/or other materials which tend to collect on the coated articles during transport, storage and/or handling.

While the aforesaid types of damage often occur prior to heat treatment (e.g., tempering), the tempering of the coated sheets typically magnifies such damage. For example, a minor bit of corrosion which was caused pre-tempering can lead to a significant blemish upon heat treatment which causes the coated sheet to be scrapped. The same is true for scratch damage because scratches in a coating allow oxidation to occur deep within the coating and possibly at the silver layer(s) during heat treatment (e.g., tempering) since heat treatment is typically conducted in an oxygen-inclusive atmosphere. Thus, the damage to a coated article often tends to be worse following heat treatment. Accordingly, it can be seen that yields appreciably suffer due to pre-HT damage that tends to occur to coated glass sheets.

To better protect coated glass sheets in various processing stages, temporary protective coatings have been developed. See, for example, U.S. Publication Nos. 2005/0210921 and 2008/0302462, and U.S. application Ser. Nos. 12/222,071 and 12/222,459, the entire contents of each of which are hereby incorporated herein by reference. The temporary protective coatings may be applied in solid or liquid forms and are designed such that they can be easily removed, typically by peeling.

Glass coating companies often require coating edge deletion for many of their products, for example, to help ensure proper adhesion of materials such as sealants to their glass surfaces. In this regard, edge deletion tables are known. See, for example, U.S. Pat. Nos. 4,716,686; 5,713,986; 5,934,982; 6,971,948; 6,988,938; 7,125,462; and 7,140,953, each of which is hereby incorporated herein in its entirety. A series of casters provided to the table allow for smooth movement of glass across the surface of the table. Grinding wheels of various widths may be used in connection with shields to help reduce the scattering of debris and for safety purposes. Passing the glass substantially consistently under the deletion head efficiently "deletes" the coating from the glass so that it can be used, for example, with sealants in intermediate or finished products. Wider or narrower grinding wheels may be used to delete more or less coating from the glass surface.

It will be appreciated that it would be advantageous to perform edge deletion when a temporary protective coating is on a coated article, e.g., without having to remove the temporary protective coating from the area where edge deletion is to be performed. Unfortunately, however, this is not possible using current apparatuses. Indeed, current apparatuses are designed only to edge delete the coating disposed on the substrate. Thus, the temporary protective coating needs to be at least partially removed prior to edge deletion. However, removing too much of the temporary protective coating exposes the underlying coated substrate, whereas removing too little will hamper, and often completely prevent, proper edge deletion. In either case, the manual or even machine removal of the temporary protective coating introduces additional process steps and/or risks damage to the articles and/or machinery involved, thus injecting delays into the process, reducing yield, and increasing costs.

Simply attempting to perform edge deletion with the temporary protective coating on the coated article does not work, as the edge deletion table is not designed to work in this way. Indeed, sometimes the temporary protective coating is removed and only part of the coating disposed on the substrate is removed, whereas other times the coating may be marred or otherwise damaged but not sufficiently deleted. The temporary protective coating may wrinkle or otherwise become deformed or damaged adjacent the portion where edge deletion is supposed to occur. A significant amount of debris also is typically produced when edge deletion with the temporary protective coating on the coated article is attempted, and this debris often will contaminate the room, remain on or otherwise negatively impact the substrate, create problems for the edge deletion unit (such as, for example, clogging, etc.), and/or lead to other drawbacks.

Thus, it will be appreciated that there is a need in the art for techniques for edge deleting coatings provided to coated articles when temporary protective coatings are applied thereto, e.g., at a common area of interest. It also will be appreciated that, as a part of such techniques, it would be advantageous to control the debris produced when edge deletion is performed on a coated article having a temporary protective coatings applied thereto.

In certain example embodiments of this invention, an apparatus is provided. The apparatus of certain example embodiments comprises (1) a substantially horizontally oriented edge deletion table; (2) an edge deletion unit suspended above the edge deletion table, with the edge deletion unit comprising a grinding wheel and a nozzle located proximate to the grinding wheel; (3) an aspirator located adjacent to the apparatus; and (4) tubing connecting the aspirator to the nozzle of the edge deletion unit. The grinding wheel of the edge deletion unit and the aspirator are arranged so as to cooperate in allowing the apparatus to edge delete a coated article and remove a temporary protective coating provided to the coated article from a common area of interest.

In certain example embodiments of this invention, an edge deletion apparatus is provided. An edge deletion table is provided in connection therewith. An edge deletion unit is suspended above the edge deletion table, with the edge deletion unit comprising (1) a grinding wheel, (2) a nozzle located proximate to the grinding wheel, and (3) a shield provided generally around the sides of the grinding wheel such that at least a bottom portion of the grinding wheel protrudes downwardly from the shield. An aspirator is located adjacent to the apparatus, with the aspirator being stationary during operation. Tubing connects the aspirator to the nozzle of the edge deletion unit. The grinding wheel of the edge deletion unit and the aspirator are arranged so as to cooperate in allowing the apparatus to edge delete a coating on a coated article and remove a temporary protective coating provided to the coated article from a common area of interest. The aspirator is configured to capture substantially all debris created by the grinding wheel when a coating on a coated article is edge deleted and a temporary protective coating provided thereto is removed.

In certain example embodiments of this invention, a method of edge deleting a coating supported by a substrate having a temporary protective coating provided thereon is provided. There is provided an apparatus comprising (1) a substantially horizontally oriented edge deletion table, (2) an edge deletion unit suspended above the edge deletion table, the edge deletion unit comprising a grinding wheel and a nozzle located proximate to the grinding wheel, (3) an aspirator located adjacent to the apparatus, and (4) tubing connecting the aspirator to the nozzle of the edge deletion unit. The substrate supporting both the coating and the temporary protective coating is provided to the apparatus such that it advances down the edge deletion table. The grinding wheel of the edge deletion unit and the aspirator are allowed to cooperate to perform edge deletion on the coating provided to the coated article and remove the temporary protective coating provided thereto, from a common area of interest. Via the aspirator, substantially all debris created by the grinding wheel when the coating provided to the coated article is edge deleted and the temporary protective coating provided thereto is removed is captured.

In general, methods for edge deleting a coating supported by a substrate having a temporary protective coating provided thereon may take advantage of any of the apparatuses disclosed herein in certain example embodiments.

The features, aspects, advantages, and example embodiments described herein may be combined to realize yet further embodiments.

BRIEF DESCRIPTION OF THE DRAWINGS

These and other features and advantages will be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
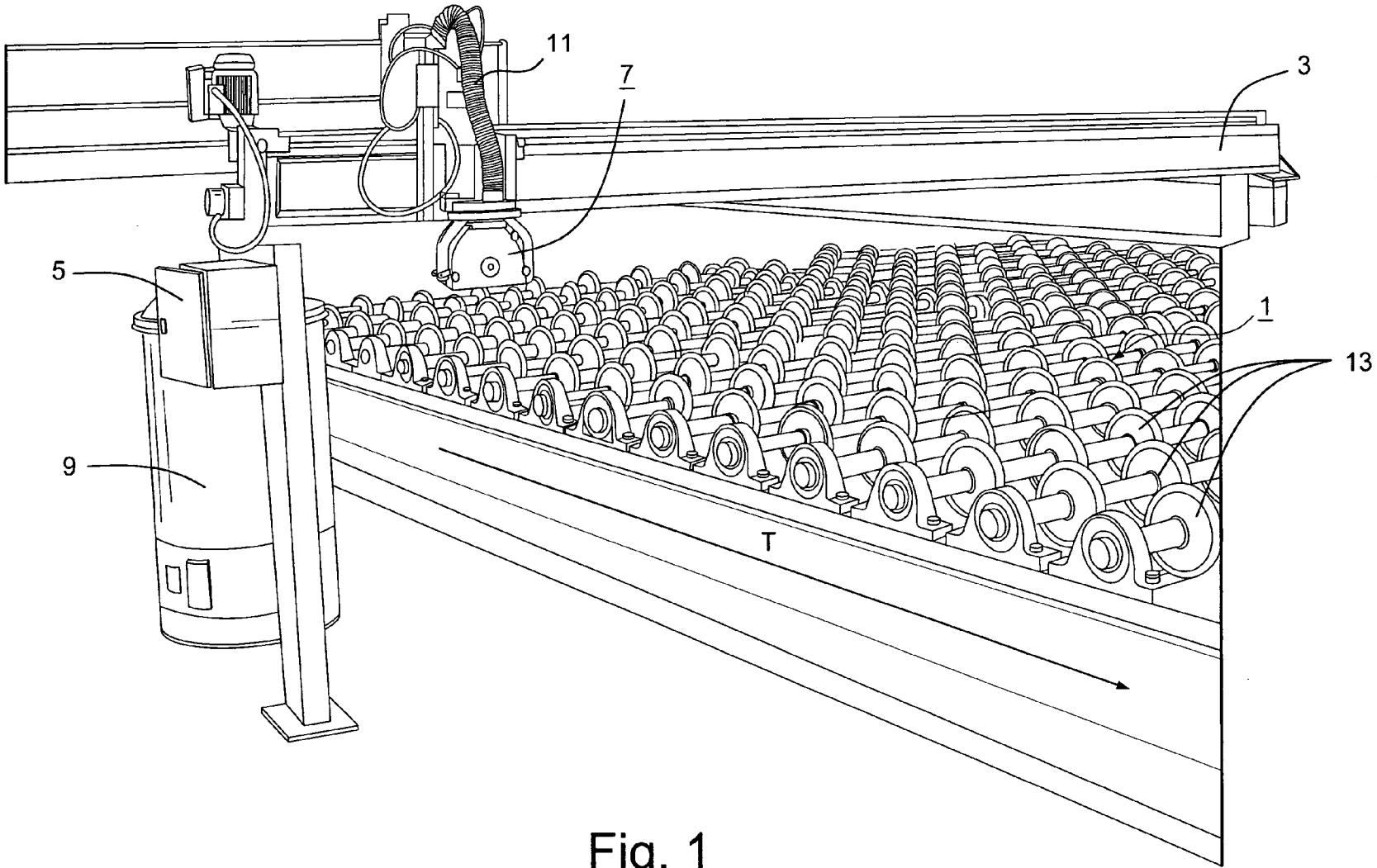
FIG. 1 is an overview of an apparatus in accordance with an example embodiment of this invention.

Certain example embodiments of this invention relate to techniques for debris reduction when performing edge deletion on coated articles having temporary protective coatings applied thereto. In certain example embodiments, a stationary (at least in operation), enlarged, and higher powered aspirator connected to flexible tubing, which itself has an enlarged diameter, that has a nozzle located proximate to a grinding wheel on an edge deletion unit is provided in connection with an edge deletion table. Advantageously, the edge deletion table and aspirator of certain example embodiments are capable of performing edge deletion and removal of a temporary protective coating substantially simultaneously, e.g., at a common area of interest, during which process the debris produced when edge deletion is performed is controlled and removed from the substrate of interest.

Referring now more particularly to the accompanying drawings in which like reference numerals indicate like parts throughout the several views, a description of the apparatus for edge deleting coatings provided to coated articles at substantially the same time a temporary protective coating is applied thereto is removed will now be made with reference to FIGS. 1-4.

More particularly, FIG. 1 is an overview of an apparatus in accordance with an example embodiment of this invention. FIG. 1 includes a table I for performing edge deletion on coated article that has a temporary protective coating applied thereto without having to first remove the temporary protective coating. In other words, the table 1 shown in FIG. 1 is capable of performing edge deletion and removing the temporary protective coating in the edge deletion area substantially simultaneously. The table 1 shown in FIG. 1 essentially serves as a substantially horizontally oriented linear guide that moves a coated substrate in the travel direction T. The table 1 is driven by an AC motor (although other motors may be used in example embodiments), and the movement of the coated substrate is facilitated by a plurality of casters 13 arranged in a plurality of rows.

A modified edge deletion unit 7 is provided for use with the table 1 for substantially simultaneous edge deletion and removal of the temporary protective coating. In the case of single-axis edge deletion, a support or guide beam 3 is provided. The edge deletion unit 7 is arranged to move along the support beam 3 in operation. As shown in FIG. 1, the support beam 3 is oriented substantially perpendicular to the travel direction T of the coated article. It will be appreciated, however, that the support beam 3 need not be used in all embodiments of this invention. For example, edge deletion may be performed by a substantially stationary (at least in operation) edge deletion unit 7 in certain example embodiments. In certain example embodiments, the edge deletion unit 7 may be suspended from a load hook or other suitable mechanical mechanisms to provide for two moving axis configurations. Still other arrangements also are possible.

An improved aspirator 9 is connected to the edge deletion unit 7 via a tubing or piping system 11. The aspirator 9 is powered by a power supply 5.

Figure 2:
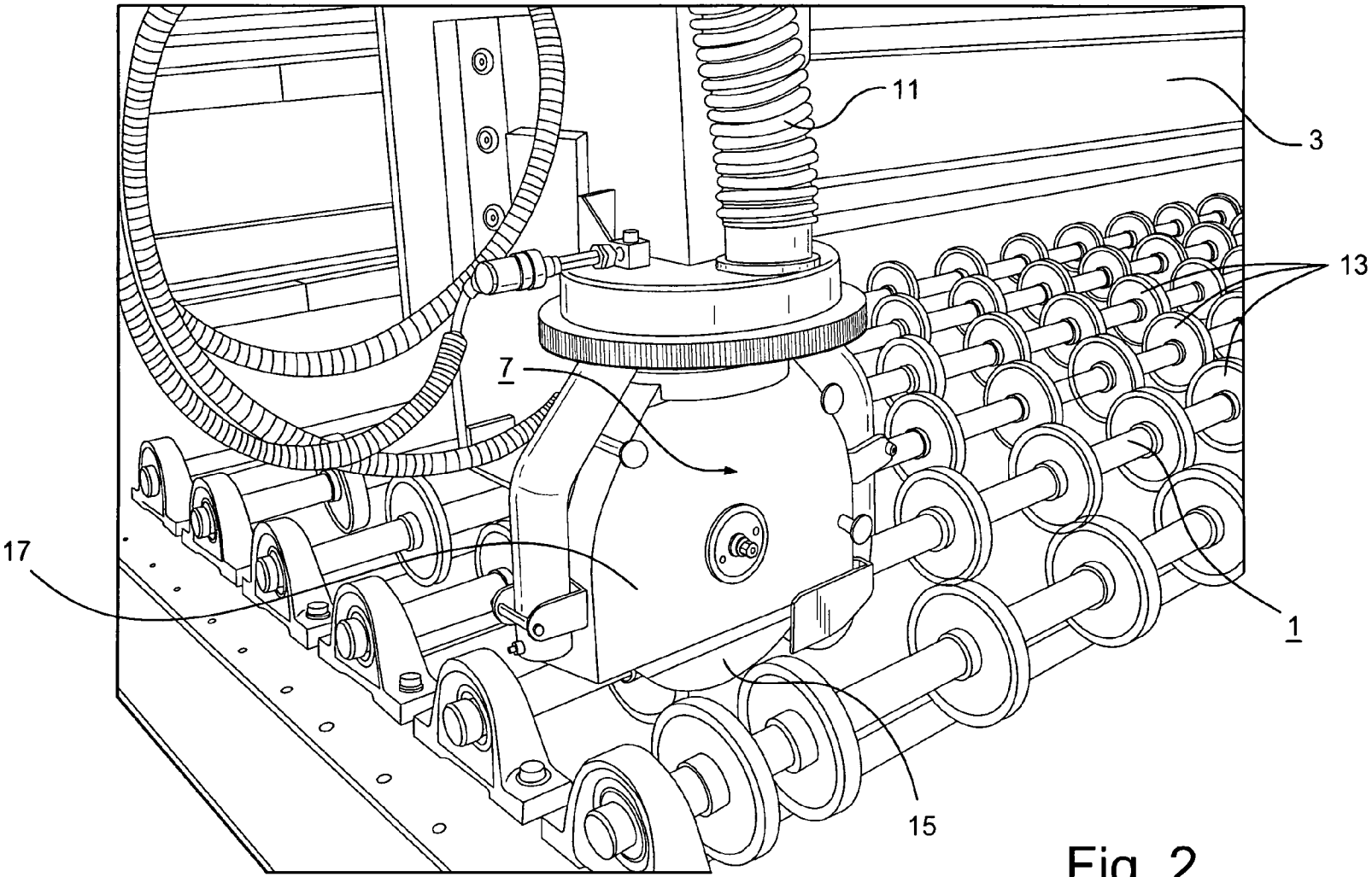
FIG. 2 is an enlarged view of an edge deletion unit of the apparatus of FIG. 1 in accordance with an example embodiment of this invention.

FIG. 2 is an enlarged view of an edge deletion unit 7 of the apparatus of FIG. 1 in accordance with an example embodiment of this invention. As shown in FIG. 2, the edge deletion unit 7 comprises a grinding wheel 15, which is provided vertically proximate to an upper surface of the table 1. It will be appreciated that the size of the grinding wheel 15 may be selected in dependence on, for example, the area to be edge deleted, etc. For example, a grinding wheel 15 with an increased width may be provided where it is desirable to perform edge deletion and temporary protective coating removal on a broader area, e.g., in a single pass, and vice versa. An optional shield 17 is provided, e.g., to protect the grinding wheel 15, reduce the likelihood of injury to a person, control the spread of debris, etc. The shield 17 is provided generally around the sides of the grinding wheel 15, e.g., such that at least a bottom portion of the grinding wheel 15 protrudes downwardly and towards the table 1 from the shield 17.

To capture and aspirate the debris, an aspiration nozzle connected to the tube 11 is modified from its conventional design. In fact, the entire diameter of the aspiration tube 11 (along with the nozzle) is increased, e.g., so as to accommodate (e.g., capture and transport) the increased amount of debris produced when the temporary protective coating is ground off along with the coating on the coated article. Thus, this increased diameter also allows for greater aspiration. Conventional apparatuses often have tubing of no more than 15 mm in diameter. The largest known tubing on a conventional apparatus has a diameter of 35 mm. In contrast, certain example embodiments may include tubing having a diameter or opening of at least about 40 mm. Certain example embodiments may include tubing having a diameter or opening of at least about 60 mm. Surprisingly and unexpectedly, it has been determined that tubing with a 40 mm diameter or opening was sufficient to capture debris and were easy to integrate with the overall apparatus. In certain example embodiments, rigid tubing may be provided near the nozzle whereas flexible tubing may be provided elsewhere in the apparatus or system. In certain example embodiments, the flexible tubing may have a diameter or opening that is slightly larger than that of the rigid tubing. For example, in certain example embodiments, the flexible tubing may have a diameter or opening of 40 mm, whereas the rigid tubing proximate to the nozzle may have a diameter or opening of only about 30 mm. It is noted that the nozzle (which may be an enclosure around the grinding wheel 15 about 5 mm from the glass plate) captures the debris. In certain example embodiments, the nozzle may be approximately 25×30 mm.

The height of the distribution rotary disk also may be adjusted to prevent blockages from being formed, for example, when the temporary protective coating is grounded off of the coated article (along with the coating supported by the substrate as a part of the actual edge deletion) by the grinding wheel 15. In this regard, the debris channel inside the rotary disk may be increased, e.g., so as to account for the increased thickness of combination of the coated article and the temporary protective coating applied thereto to be removed along with the portion of the coated article to be edge deleted. It has been determined that a cross-sectional area of about 200 $mm^2$ for the channel inside the distribution rotary disk works particularly well in certain example embodiments. The channel may be substantially leak-proof in certain example embodiments. These features surprisingly and unexpectedly result in superior debris collection, while at the same time reducing the likelihood of channel blockage. In certain example embodiments, the additional height of the temporary protective coating may be automatically respected by the control system of the apparatus. In general, a distance of about 5 mm between the substrate and the nozzle during edge deletion has been found to be particularly advantageous. This is because the wheel already throws the debris substantially directly into the nozzle (e.g., comparable to the flying sparks of an angle grinder). To achieve the capturing, the nozzle may enclose the wheel as far as possible, and the nozzle may be situated behind the wheel. Conventional apparatuses do not do this effective since, even if the distance of the nozzle is adjusted to about 5 mm, the nozzle quite often is too small or too far away from the wheel to capture the flying debris. In certain example embodiments, it is advantageous to increase the substantially vertical spacing between the edge deletion unit 7 and the top-most surface of the substrate to account for this difference, whereas it is advantageous in certain example embodiments to decrease the substantially vertical spacing between the edge deletion unit 7 and the top-most surface of the substrate (e.g., to help ensure that more debris is captured by the aspirator). However, as noted above, this may be done automatically, e.g., via the apparatus, in certain example embodiments.

Conventional edge deletion tables typically include very small aspirators. Such aspirators conventionally are mounted on a moving head and often are only about 20 cm tall. Such conventional designs are suitable for edge deletion, as a very small amount of debris is produced, e.g., because the amount of material to be removed is so small. However, as noted above, when the temporary protective coating is removed along with the portion to be edge deleted, a significant amount of debris can be generated. Conventional aspirators are not capable of capturing the significantly increased amount of debris and thus are not suitable for substantially simultaneous edge deletion and temporary protective coating removal.

Figure 3:
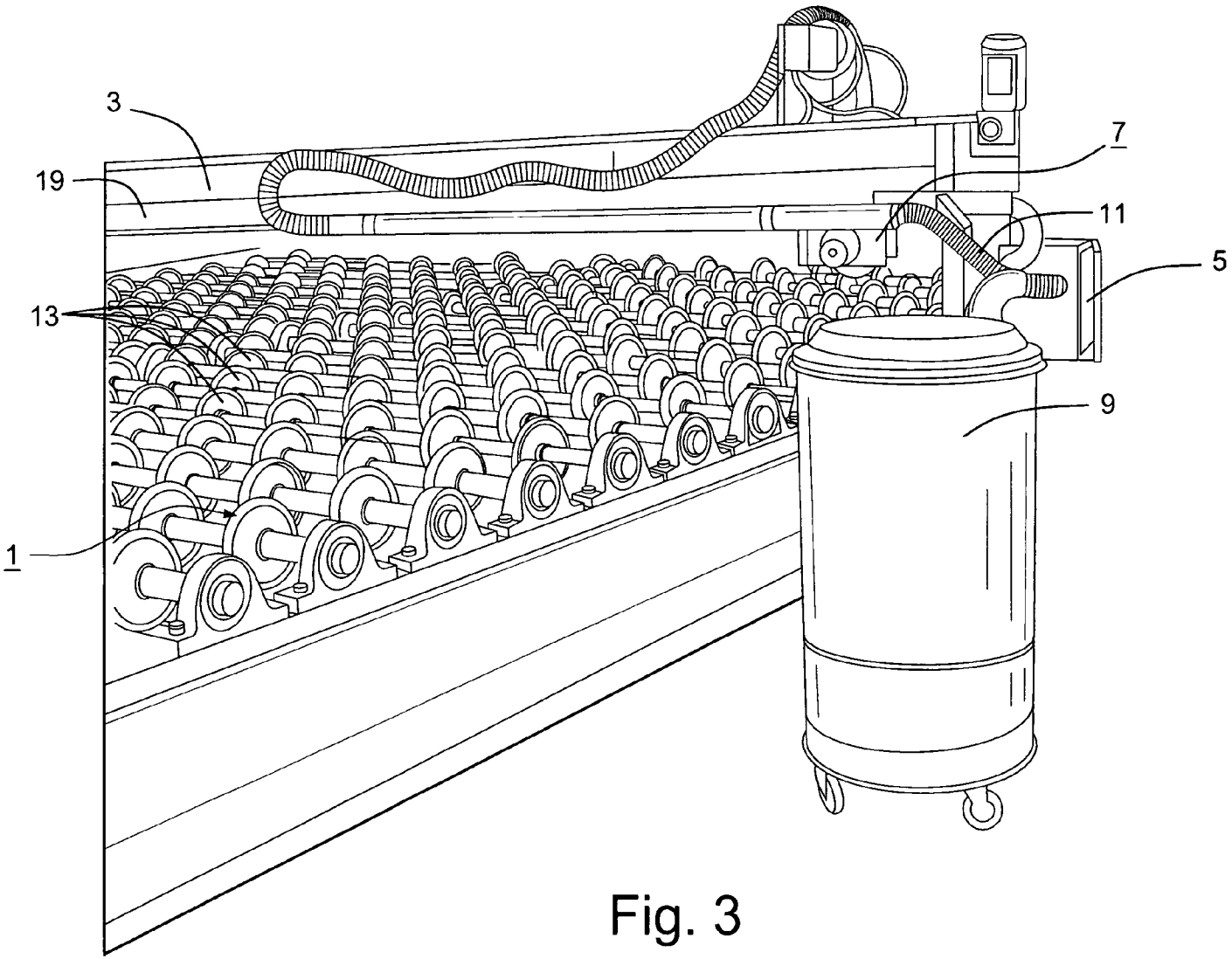
FIG. 3 is an enlarged view of an aspirator of the apparatus of FIG. 1 in accordance with an example embodiment of this invention.

FIG. 3 is an enlarged view of an aspirator 9 of the apparatus of FIG. 1 in accordance with an example embodiment of this invention. Rather than being mounted on a moving or stationary head, the improved aspirator 9 of certain example embodiments is provided adjacent to the edge deletion table 1. As can be deduced from FIG. 3, the improved aspirator 9 is significantly larger than conventional aspirators. Indeed, rather than being only 20 cm in height as is conventional, the improved aspirator 9 shown in FIG. 3 actual stands about 1 meter tall. Because of its increased size, a larger power supply 5 may be required. Preferably, the power supply 5 will be at least a 2.2 kW electric power supply provided at a fixed location. More preferably, the power supply 5 will be at least about a 2.5 to 4 kW electric power supply. For example, 2.2 kW electric power supplies have been found to be sufficient for use in connection with single axis embodiments having 5 m worth of flexible tubing. For two-axis embodiments with 11-13 m of tubing, 3.7 kW electric power supplies have been found to be sufficient. It will be appreciated that the size of power of the aspirator 9 may depend on, for example, whether one-axis or two-axis embodiments are used, the length of the tubing, etc. It is noted that the power of conventional aspirators depends on the machine. Some existing apparatuses have small aspirators that are the size of a coffee pot and are driven by 24 volts. Other conventional machines have pneumatic venturis. Some newer apparatuses have larger and more highly powered aspirators that are mounted on the edge deletion head. However, even these newer, more highly powered aspirators are powered by less than 1 kW and have small bags attached thereto which very quickly fill up.

As alluded to above, the aspirator 9 is non-trivial is size. Accordingly, the aspirator 9 may be provided at a fixed location (although wheels may be provided to the aspirator 9 in certain example embodiments so that it may be moved when not in operation or even when in operation). In such cases, the flexible tubing or piping system 11 described above may help connect the nozzle located proximate to the grinding wheel 15 to the aspirator 9 located remote from it. In general, 10 meter long tubing will be sufficient for performing edge deletion on large pieces of stock glass that have been coated. Of course, it will be appreciated that longer or shorter runs of the flexible tubing or piping system 11 also may be provided in certain example embodiments of this invention.

As noted above, the table 1 may provide for single-axis edge deletion, in which case it may be advantageous to include a cable catenary 19 to help accommodate the one moving axis. This arrangement is shown visually in the example embodiment of FIG. 3. Also as noted above, a load hook (not shown) may be provided in case of two moving axes. In other words, a movable load hook may be provided over the edge deletion table, with the load hook being movable in a first direction substantially perpendicular to a travel direction of a glass substrate and/or a second direction substantially parallel to the travel direction of the glass substrate, and the edge deletion unit may be suspended via and movable along with the load hook so as to enable two-axis edge deletion and temporary protective coating removal. Of course, it will be appreciated that other arrangements also are possible in addition to, or in place of, those shown and described herein.

Figure 4:
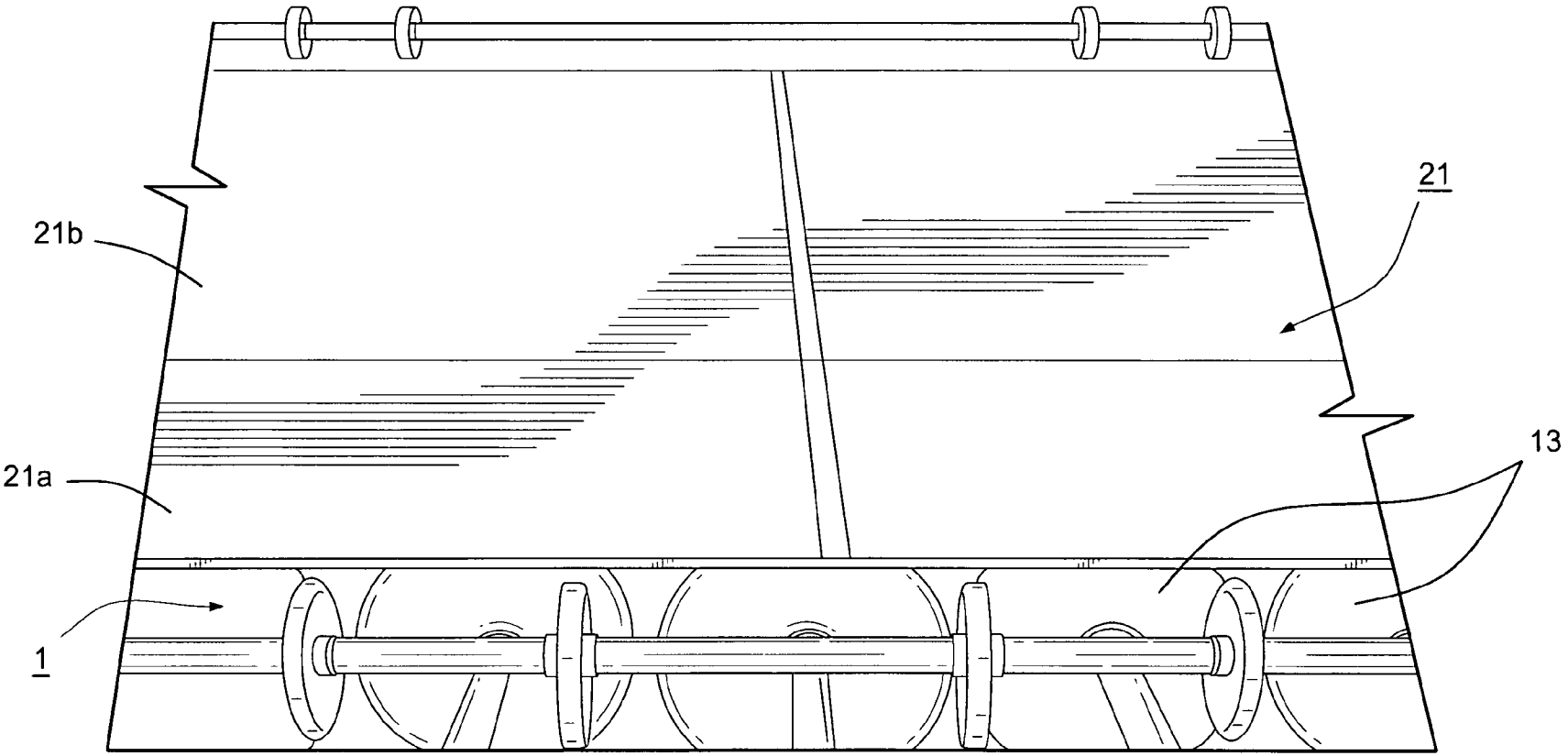
FIG. 4 is an end view of an edge-deleted glass substrate produced using the apparatus of FIG. 1 in accordance with an example embodiment of this invention.

FIG. 4 is an end view of an edge-deleted glass substrate produced using the apparatus of FIG. 1 in accordance with an example embodiment of this invention. In particular, FIG. 4 shows a coated substrate 21 located on the edge deletion table 1 of the FIG. 1 example embodiment. Prior to edge deletion via the edge deletion table 1 of the FIG. 1 example embodiment, the substrate 21 had a thin film coating applied thereto (e.g., via sputtering or the like) and had a temporary protective coating applied thereto so as to substantially cover and thus protect substantially the entire upper surface of the substrate 21. However, FIG. 4 shows the substrate 21 once edge deletion according to certain example embodiments has been performed. Thus, in a first area 21*a* of the substrate 21 where edge deletion was performed, the bare surface of the substrate is exposed. By contrast, in a second area 21*b* of the substrate 21 where edge deletion was not performed, the substrate is still coated with a thin film coating and still is protected via the temporary protective coating. As can be seen from FIG. 4, little to no debris produced by the edge deletion unit 7 is present, either on the table 1, or on or near the substrate 21.

As such, it will be appreciated that it is possible to use the techniques of the example embodiments described herein to effectively and efficiently remove temporary protective coatings typically applied over coated substrates substantially at the same time as (e.g., in the same step as) edge deletion is performed in the same area. This becomes possible in certain example embodiments because the amount of debris produced is controlled and removed.

Given the above, it will be appreciated that in certain example embodiments of this invention, a method of edge deleting a coating supported by a substrate having a temporary protective coating provided thereon is provided. There is provided an apparatus comprising (1) a substantially horizontally oriented edge deletion table, (2) an edge deletion unit suspended above the edge deletion table, the edge deletion unit comprising a grinding wheel and a nozzle located proximate to the grinding wheel, (3) an aspirator located adjacent to the apparatus, and (4) tubing connecting the aspirator to the nozzle of the edge deletion unit. The substrate supporting both the coating and the temporary protective coating is provided to the apparatus such that it advances down the edge deletion table. The grinding wheel of the edge deletion unit and the aspirator are allowed to cooperate to perform edge deletion on the coating supported by the coated article and remove the temporary protective coating provided thereto, from a common area of interest. Via the aspirator, substantially all debris created by the grinding wheel when the coating supported by the coated article is edge deleted and the temporary protective coating provided thereto is removed is captured.

It will be appreciated that the example embodiments described herein may be used in connection with the edge deletion of single layer or multiple layer coatings. Such single layer or multiple layer coatings may be deposited by any suitable means including, for example, sputtering, chemical vapor deposition (CVD), combustion CVD, flame or spray pyrolysis, spin coating, sol-gel coating, etc. Also, it will be appreciated that the example embodiments described herein may be used in connection with a variety of temporary protective coatings in place of, or in addition to, those described herein. Such temporary protective coatings may be applied in solid or in liquid form.

While a particular layer or coating may be said to be "on" or "supported by" a surface or another coating (directly or indirectly), other layer(s) and/or coatings may be provided therebetween. Thus, for example, a coating may be considered "on" and "supported by" a surface even if other layer(s) are provided between layer(s) and the substrate. Moreover, certain layers or coatings may be removed in certain embodiments, while others may be added in other embodiments of this invention without departing from the overall spirit of certain embodiments of this invention. Thus, by way of example, an encapsulating coating applied in liquid sol-gel form in accordance with an example embodiment may be said to be "on" or "supported by" a sputtering target material, even though other coatings and/or layers may be provided between the sol-gel formed coating and the target material.

"Peripheral" and "edge" as used herein do not necessarily mean the absolute periphery or edge of the subject substrate, but instead mean that the area of interest is at least partially located at or near (e.g., within about six inches) an edge of the substrate. Likewise, "edge" as used herein is not limited to the absolute edge of a substrate but also may include an area at or near (e.g., within about six inches) of an absolute edge of the substrate(s).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of edge deleting, the method comprising:

providing a low-E coating supported by a first major surface of a substrate having a polymer based temporary protective coating provided over at least the low-E coating on the first major surface of the substrate so that the polymer based temporary protective coating is located directly on and over the low-E coating;

providing an apparatus, the apparatus comprising (1) a substantially horizontally oriented edge deletion table, (2) an edge deletion unit suspended above the edge deletion table, the edge deletion unit comprising a grinding wheel and a nozzle located proximate to the grinding wheel, (3) an aspirator located adjacent to the apparatus, and (4) tubing connecting the aspirator to the nozzle of the edge deletion unit, wherein at least part of the tubing has a diameter and/or opening of at least about 40 mm;

providing the substrate supporting both the low-E coating and the polymer based temporary protective coating to the apparatus such that it advances down the edge deletion table; and allowing the grinding wheel of the edge deletion unit and the aspirator to cooperate to perform edge deletion on the low-E coating supported by the coated article and remove the polymer based temporary protective coating provided thereto, from a common area of interest.

2. The method of claim 1, further comprising capturing, via the aspirator, substantially all debris created by the grinding wheel when the low-E coating supported by the coated article is edge deleted and the temporary protective coating provided thereto is removed.

* * * * *